US008465130B2

(12) United States Patent
Xu et al.

(10) Patent No.: US 8,465,130 B2
(45) Date of Patent: Jun. 18, 2013

(54) PRINTHEAD HAVING IMPROVED GAS FLOW DEFLECTION SYSTEM

(75) Inventors: Jinquan Xu, Rochester, NY (US); Joseph E. Yokajty, Webster, NY (US); Todd R. Griffin, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/491,726

(22) Filed: Jun. 8, 2012

(65) Prior Publication Data

US 2012/0242759 A1 Sep. 27, 2012

Related U.S. Application Data

(62) Division of application No. 12/265,133, filed on Nov. 5, 2008, now Pat. No. 8,220,908.

(51) Int. Cl.
*B41J 2/12* (2006.01)
*B41J 2/105* (2006.01)

(52) U.S. Cl.
USPC ..... 347/77; 347/78

(58) Field of Classification Search
USPC ..... 347/77–78
See application file for complete search history.

(56) References Cited

U.S. PATENT DOCUMENTS

| | | | | |
|---|---|---|---|---|
| 4,068,241 | A | 1/1978 | Yamada | |
| 4,532,166 | A | 7/1985 | Thomsen et al. | |
| 5,273,799 | A | 12/1993 | Yu et al. | |
| 5,549,999 | A | 8/1996 | Swain et al. | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 7,404,627 | B1 * | 7/2008 | Gao et al. | 347/77 |
| 2003/0059280 | A1 | 3/2003 | Stevens | |

(Continued)

FOREIGN PATENT DOCUMENTS

| | | | |
|---|---|---|---|
| EP | 1 219 429 | A2 | 7/2002 |
| EP | 1 308 278 | A1 | 5/2003 |
| EP | 1 228 873 | B1 | 10/2005 |

OTHER PUBLICATIONS

U.S. Appl. No. 11/744,998, filed May 7, 2007, Randolph C. Brost et al.

*Primary Examiner* — Jerry Rahll
(74) *Attorney, Agent, or Firm* — William R. Zimmerli

(57) ABSTRACT

A printhead includes a drop generator configured to selectively form a large volume drop and a small volume drop from liquid emitted through a nozzle associated with the drop generator, the large volume drop and the small volume drop traveling along an initial drop trajectory, and a gas flow deflection system including a gas flow that interacts with the large volume drop and the small volume drop in a drop deflection zone such that at least the small volume drop is deflected from the initial drop trajectory, the gas flow being provided by a gas flow source connected in fluid communication with a gas flow duct, the gas flow deflection system including a gas flow pressure oscillation dampening structure located between the gas flow source and the drop deflection zone.

3 Claims, 8 Drawing Sheets

U.S. PATENT DOCUMENTS

2004/0095441 A1 5/2004 Jeanmaire
2008/0278550 A1 11/2008 Xu et al. ..... 347/77
2009/0244180 A1* 10/2009 Panchawagh et al. ..... 347/44

* cited by examiner

PRINTHEAD HAVING IMPROVED GAS FLOW DEFLECTION SYSTEM

CROSS REFERENCE TO RELATED APPLICATIONS

This is a divisional application of U.S. application Ser. No. 12/265,133 filed Nov. 5, 2008 now U.S. Pat. No. 8,220,908.

Reference is made to commonly assigned U.S. patent application Ser. No. 11/744,998 filed May 7, 2007, entitled "PRINTER HAVING IMPROVED GAS FLOW DROP DEFLECTION" by Randolph C. Brost et al., incorporated herein by reference.

FIELD OF THE INVENTION

This invention relates generally to the management of gas flow and, in particular to the management of gas flow in to continuous printing systems in which a liquid stream breaks into droplets, at least some of which are deflected by a gas flow.

BACKGROUND OF THE INVENTION

In printing systems, for example, inkjet printing systems, it is critical to provide systems having predictable and accurate printed drop placement in order to reduce image defects and maintain print quality standards. Conditions which may lead to reduced printed drop placement accuracy resulting in increased image defects and reduced print quality should to be minimized.

SUMMARY OF THE INVENTION

The present invention helps to provide predictable and accurate printed drop placement by reducing gas flow velocity fluctuations in printing systems that use a gas flow to create print drops and non-print drops.

According to one aspect of the present invention, a printhead includes a drop generator and a gas flow deflection system. The drop generator is configured to selectively form a large volume drop and a small volume drop from liquid emitted through a nozzle associated with the drop generator. The large volume drop and the small volume drop travel along an initial drop trajectory. The gas flow deflection system includes a gas flow that interacts with the large volume drop and the small volume drop in a drop deflection zone such that at least the small volume drop is deflected from the initial drop trajectory. The gas flow is provided by a gas flow source connected in fluid communication with a gas flow duct. The gas flow deflection system includes a gas flow pressure oscillation dampening structure located between the gas flow source and the drop deflection zone.

According to another aspect of the present invention, a printhead includes a drop generator, a gas flow deflection system, and a plenum structure. The drop generator is configured to selectively form a large volume drop and a small volume drop from liquid emitted through a nozzle associated with the drop generator. The large volume drop and the small volume drop travel along an initial drop trajectory. The gas flow deflection system provides a first gas flow through a gas flow duct. The first gas flow interacts with the large volume drop and the small volume drop in a drop deflection zone such that at least the small volume drop is deflected from the initial drop trajectory. The first gas flow has a first speed. A plenum structure includes an outlet located between the drop generator and the gas flow duct that directs a second gas flow toward the drop deflection zone. The second gas flow has a second speed. The first speed of the first gas flow is substantially equivalent to the second speed of the second gas flow.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
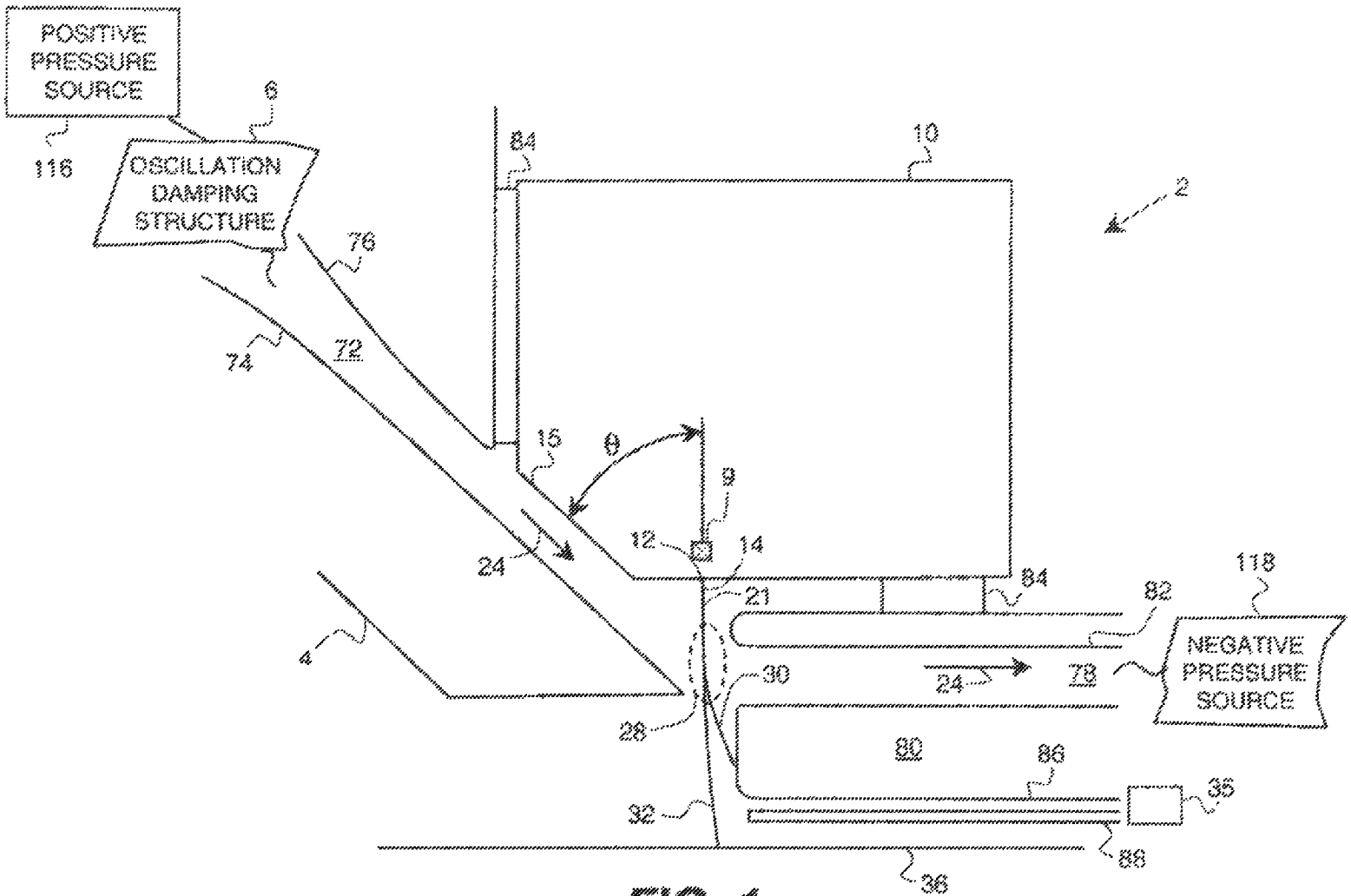
FIG. 1 is a schematic side view of a printing system with a fluid flow device including an example embodiment of the present invention.

The present description will be directed in particular to elements forming part of, or cooperating more directly with, apparatus in accordance with the present invention. It is to be understood that elements not specifically shown or described can take various forms well known to those skilled in the art.

The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink. Accordingly, the media includes not only print media, but also other structures, for example, circuit board material, stereo-lithographic substrates, medical delivery devices, etc.

FIG. 1 shows a printing apparatus incorporating an example embodiment of the present invention. The printing apparatus comprises a printhead 2 and a gas flow deflection system 4. The printhead 2 has drop generator 10 with at least one nozzle 12 from which ink is emitted under pressure to form filaments of liquid 14. Stimulation device 9, for example, an electric heater, associated with the drop generator 10 is capable of perturbing the filament of liquid 14 to induce portions of the filament to break off from the main filament to form drops stream 21. Drops are selectively created in the form of large volume drops and small volume drops that fly down toward the receiving media 36.

Printheads like printhead 2 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

A gas flow deflection system 4 including a gas flow 24 in gas flow duct 72 interacts with the large volume drops and the small volume drops in the drop deflection zone 28 such that at least the small drop volume drops are deflected from the initial drop trajectory and fly along the small drop trajectory 30. The large volume drops are also deflected from the initial drop trajectory and fly along the large drop trajectory 32. As shown in FIG. 1, the small volume drop trajectory is intercepted by the front face of the catcher 80, while the large volume drops are not deflected as much as the small volume drops, missing the catcher 80 and continuing on to the receiving media 36 to form a dot. The margin between the small volume drops and the large volume drops has to big enough so that the catcher 80 can intercept the small volume drops and let the large volume drops pass by.

Another air duct 78 is located on a second side of the drop streams. It is formed between the catcher 80 and upper wall 82, and exhausts air from the deflection zone 28. Optional seals 84 provide air seals between the drop generator and the upper wall 76 and the upper wall 82. Second duct 78 can be connected to a negative pressure source 118 that is used to help remove air from second duct 78. Typically the positive pressure source 116 can be a gas pump or a gas fan.

The small drop trajectory is intercepted by the front face of the catcher 80. The ink then flows down the catcher face and into the ink return duct 86, formed between the catcher 80 and the plate 88, and is returned to the fluid system 35. The large drops are not deflected as much as the small drops, missing the catcher 80 and continuing on to the receiving media 36 to form a dot. A print image can be formed by multiple such dots on the print media.

For a general printing purpose, both the small drop volume drops and the large drop volume drops are tiny, usually ranged from sub-picoliter to hundreds of picoliter. It is obvious that trajectories of such drops are very sensitive to the gas flow in the deflection zone. Gas flow stability, uniformity and speed have to be maintained to place a drop onto a prescribed spot on the receiving media 36, or to achieve the required margin between the small volume drops and large volume drops. Also, the speed of gas flow needs to be optimized to avoid severe turbulence being generated in the drop deflection zone 28.

It has been found, even in printheads having turbulence suppressing features in the gas flow ducts, such as those disclosed in co-filed U.S. application Ser. No. 12/265,146, entitled "DEFLECTION DEVICE INCLUDING EXPANSION AND CONTRACTION REGIONS" by Todd R. Griffin et al., that the printed images can show fluctuations in optical density. These fluctuations show up as somewhat periodic light and dark bands in the direction of relative motion between the printhead and the receiving media 36. Analysis of the images has showed that the fluctuations in optical density are produced by fluctuations in the drop placement parallel to the relative motion of the printhead and the receiving media. These optical density fluctuations have been called chatter marks or chatter defect.

Figure 2A:
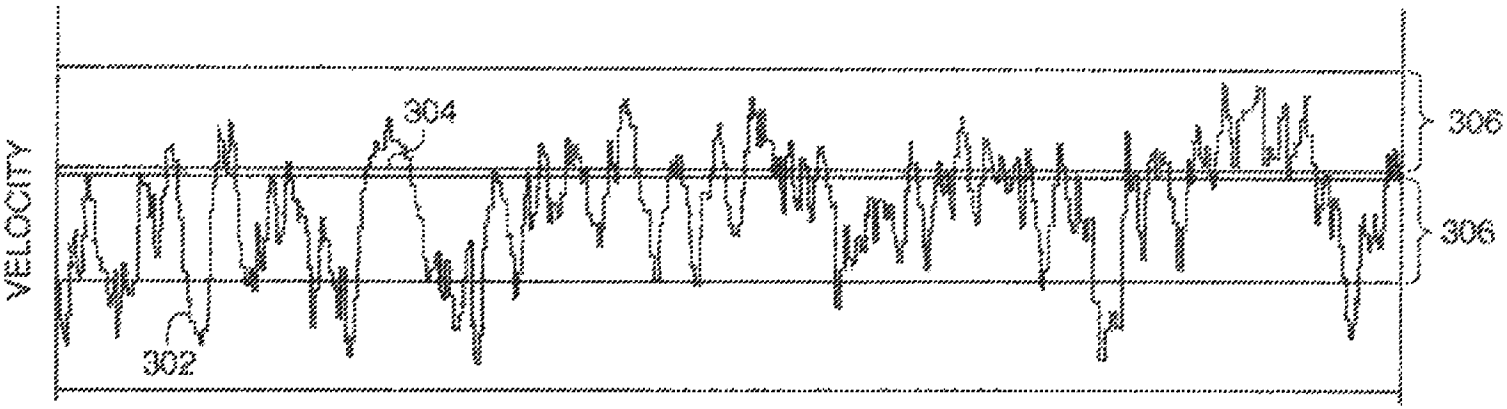
FIG. 2(A) shows experimentally measured results without incorporating the present invention into the printing system.

It has been determined that these chatter defects are related to fluctuations in gas flow velocity. FIG. 2(A) shows a gas flow velocity profile 302 measured from the exit of a positive pressure source using a hotwire anemometer. The gas flow velocity profile 302 has a mean velocity 304, and a velocity fluctuation 306. A Fourier Transform analysis shows multiple frequencies in the velocity profile 302, ranged from hundreds of Hertz to tens of thousands Hertz. For an acceptable gas flow for the printing device, the amplitudes ratio of the velocity fluctuation 306 over the mean velocity 304 is preferred to be no more than 10%. Most of the gas flow provided by the gas flow source, however, can not meet this requirement.

The gas flow 24 is provided by a gas flow source 116 connected in fluid communication with the gas flow duct 72. Typically, the gas flow source is a positive pressure source, such as a gas fan, a gas blower or a gas pump. These gas flow sources typically produce a positive pressure with some ripple or periodic oscillation in the pressure. Such oscillations can be caused, for the example of a gas fan, by the motion of each of the fan blades past parts of the fan support structure. The resulting periodic pressure oscillations produce periodic fluctuations in gas flow velocity in the gas flow duct. Gas flow velocity fluctuations from the gas flow source 116 have been experimentally detected and characterized.

To solve the gas flow velocity fluctuation issue, a gas flow pressure oscillation damping structure 6 is incorporated. Referring again to FIG. 1, the gas flow deflection system 4 includes the gas flow pressure oscillation damping structure 6 located between the gas flow source 116 and the drop deflection zone 28 to damp pressure oscillation in the gas flow before the gas flow reaches the drop deflection zone 28. The gas flow pressure oscillation damping structure 6 comprises a porous media positioned in the gas flow duct 72 such that at least a portion of the gas flows through the porous media.

Figure 2B:
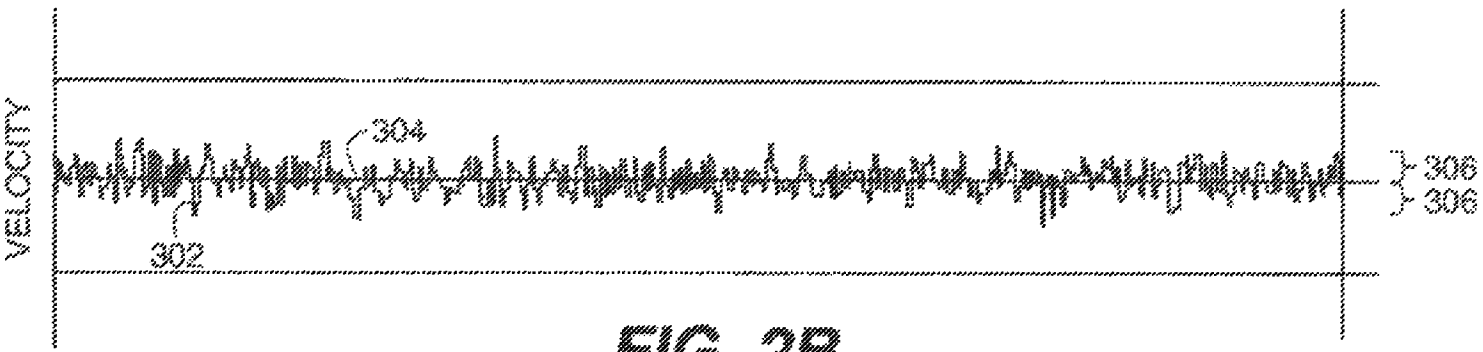
FIG. 2(B) shows experimentally measured incorporating the present invention into the printing system.

FIG. 2(B) shows a gas flow velocity profile 302 measured after the gas flow passes through a gas flow pressure oscillation damping structure 6 using the hotwire anemometer. Comparison between FIG. 2(A) and FIG. 2(B) clearly illustrates that velocity fluctuations can be significantly damped after passing through the gas flow pressure oscillation damping structure 6. Again, according to Bernoulli's principle, with the velocity fluctuations being damped, gas flow pressure oscillation is damped accordingly.

To achieve an optimal performance, the size of pores in the porous material should be smaller than the wavelength of the pressure oscillation. For example, for a gas flow v=5 m/s in the gas duct, fan periodic compressing frequency f=4000 Hz, the wavelength of the pressure oscillation, $\lambda$, can be approximated by, $\lambda=v/f$, which gives $\lambda=0.00125$ meter. That means the size of the pores in the porous media should smaller than 0.00125 meter in this case. Preferably, the size of the pores should be significantly smaller than the wavelength of the pressure oscillation. Viscous damping of the gas as it moves into and out of the pores in response to the pressure fluctuations causes the pressure fluctuations to be attenuated. An example of such porous media is an open cell foam or a fiber mat, such as cotton. Preferably the porous material is a flexible, extensional damping material with viscoelastic properties so that vibrations of the pore walls themselves are damped. For improved performance, the porous media should be secured in the gas flow duct so that the gas flow won't induce vibrations of the porous media. In one embodiment, epoxy can be applied to the interface of porous media and the gas flow duct to secure the media to the walls of the gas flow duct. An example of commercially available device that can be readily used as the gas flow pressure oscillation damping structure 6 is an air purifier & flow equalizer, for example, flow equalizers manufactured by Koby® Incorporated.

Attention should also be paid is resonance frequencies. Resonance frequencies of the gas flow pressure oscillation damping structure and the gas flow deflection system should be different from the pressure oscillation frequency of the gas flow to avoid potential acoustic/vibration resonance.

It has been found that as the gas flows through the gas flow duct, interactions of the gas flow with the gas flow duct can amplify gas flow velocity fluctuations. Referring to FIG. 1, the gas flow duct 72, having a lower wall 74 and an upper wall 76, is located on one side of the drop streams 21. The drop generator 10 has a beveled surface 15. The gas flow duct 72 and the beveled surface 15 of the drop generator 10 direct the gas supplied from a positive pressure source 116, passing the gas flow pressure oscillation structure 6, toward the drop deflection zone 28. A downward angle θ is formed between the beveled surface 15 of the drop generator 10 and the initial drop trajectory such that the gas flow is directed at a non-perpendicular non-parallel angle relative to the initial drop trajectory. Typically, the downward angle θ of approximately a 45° is preferred. Printing systems like this have been previously discussed, for example, in U.S. patent application Ser. No. 11/744,998 filed May 7, 2007, entitled "PRINTER HAVING IMPROVED GAS FLOW DROP DEFLECTION" by Randolph C. Brost et al., the disclosure of which is incorporated by reference herein.

For manufacture, operation, and maintenance considerations, the drop generator 10 and the gas flow deflection system 4 are manufactured into two separated pieces. Due to engineering tolerance, there is a small gap between the printhead 2 and the gas flow deflection system 4 when the two pieces are assembled. Typically, the gap is only hundreds of micrometers in width. The gap can be sealed with a seal 84, or left open as it is as shown in FIG. 3.

Figure 3:
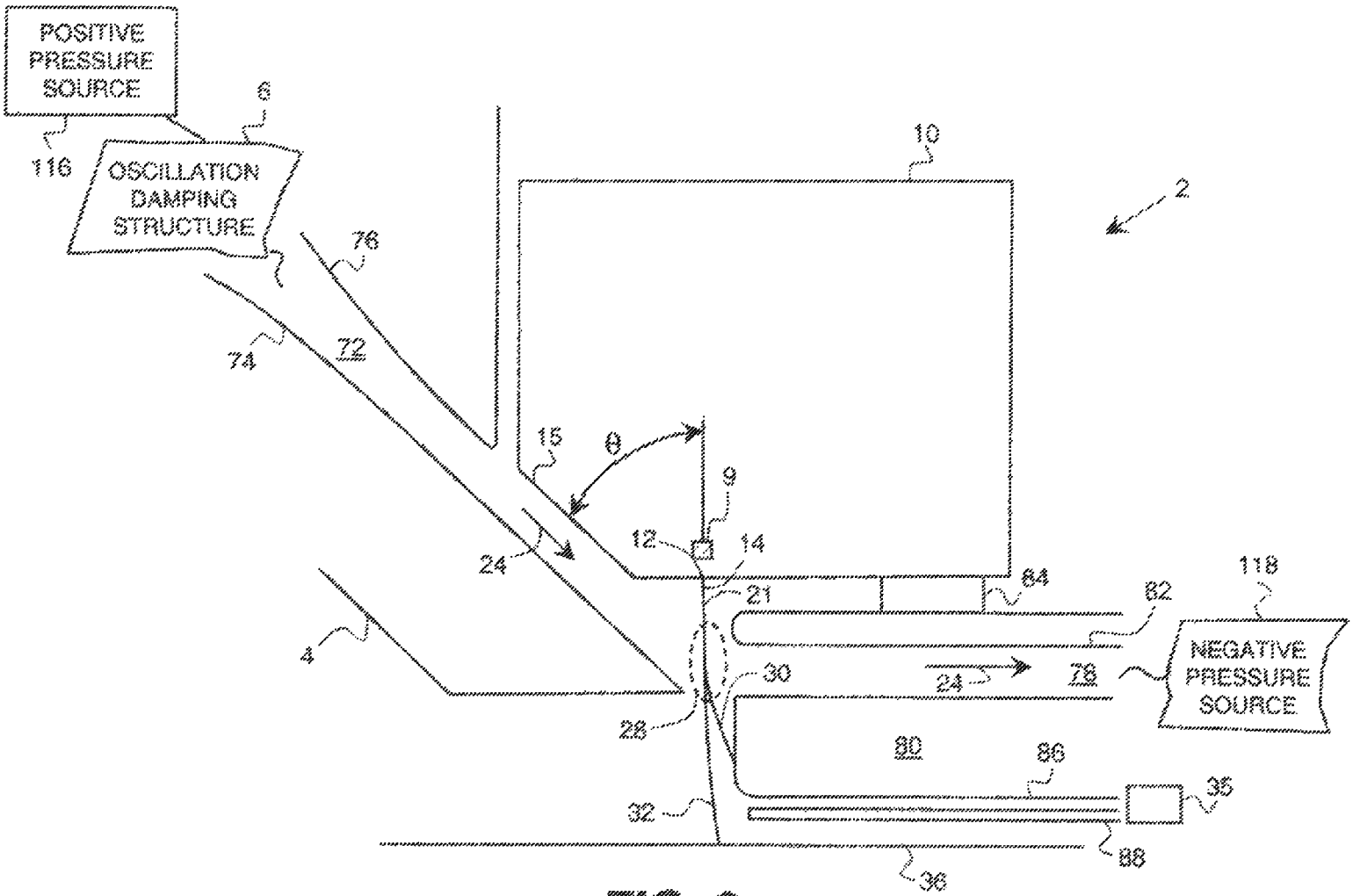
FIG. 3 is a schematic side view of a printing system with a fluid flow device incorporating an example embodiment of the present invention.

Referring to FIG. 3, the inner surface of the upper wall 76 is aligned with the beveled surface 15 of the drop generator 10. As one specific example of alignment in this case, the inner surface of the upper wall 76 is parallel and co-planer with the beveled face 15 of the drop generator 10.

Figure 4A:
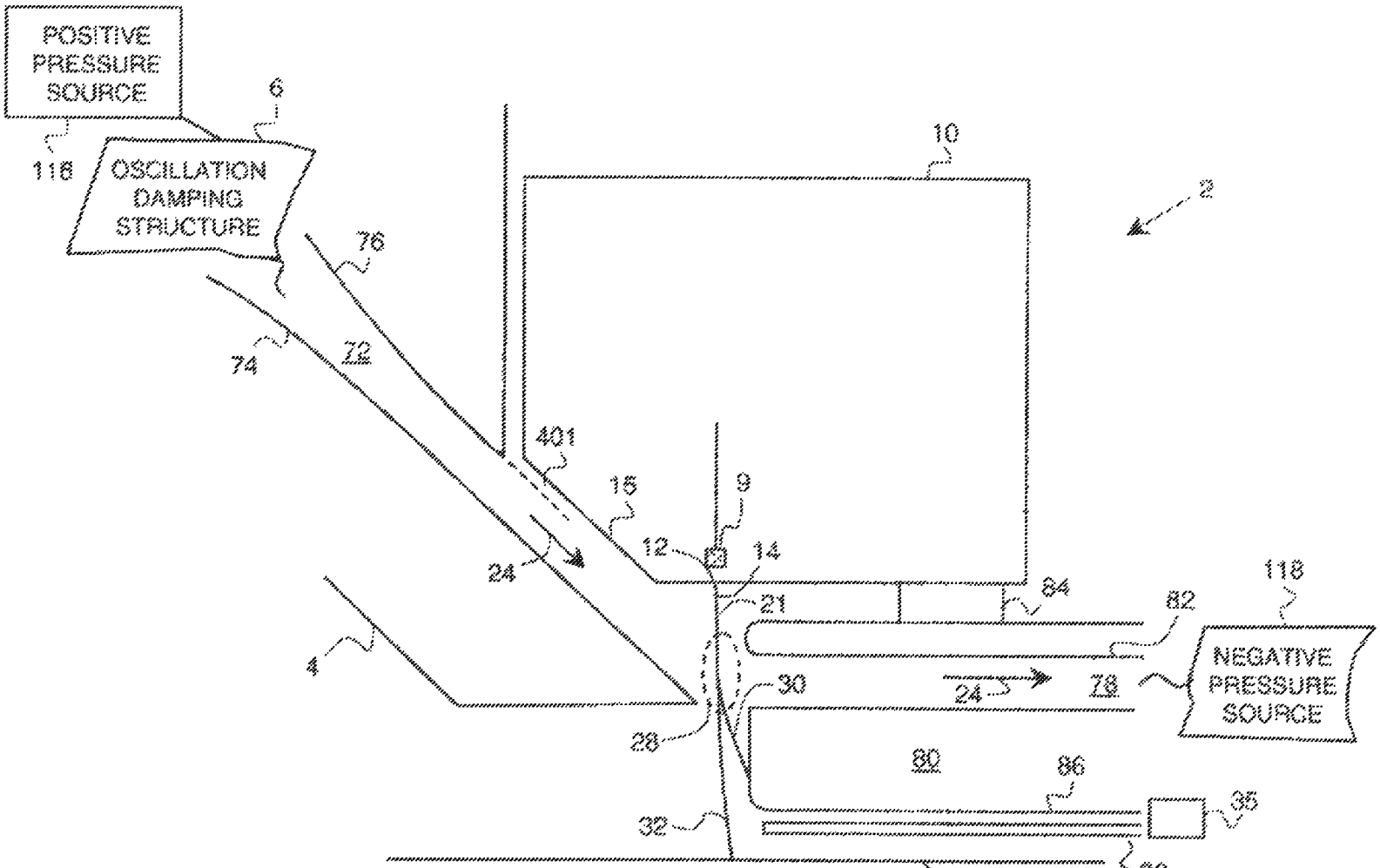
FIGS. 4(A) and 4(B) are schematic side views of printing systems that use a gas flow with velocity fluctuations to create print drops and non-print drops.

If the inner surface of the upper wall 76 is not well aligned with the beveled surface 15 of the drop generator 10, it is possible for the beveled face 15 of the drop generator 10 to be recessed by an offset 401 from the plane of the upper wall 76 as schematically shown in FIG. 4A. Usually, the offset 401 is very small, less than hundreds of micrometers, and not easily detected. Small as it is, however, the offset 401 is believed to induce fluid dynamic instability. Such instability can occur when a velocity shear is present within a continuous fluid or when there is sufficient velocity difference across the interface between two fluids. This causes the flow of fluid at the interface between the higher and lower fluids to become unstable so that the velocity of the fluid in the region of the velocity shear fluctuates. In the print device as shown in FIG. 4(A), a gas flow velocity shear can be present and induce instability because, gas flow from the gas duct 72 is relatively fast, while the gas flow in the offset 401 region is relatively slow.

For example, in the print device shown in FIG. 4(A), the gas flow velocity in the gas duct near the beveled surface 15 of the drop generator is, typically, above 10 m/s, while the gas flow velocity in the offset 401 is, typically, less than 1 m/s. This velocity shear can generate the instability, if the gas flow from the gas flow source is not perfectly stable in time. As a matter of fact, perfectly stable gas flow is virtually impossible to be generated by a positive pressure sources such a fan, a gas blower or a gas pump. If the gas flow velocity has any periodic fluctuations, the instability can amplify the velocity fluctuations as the gas flow travels toward the drop deflection zone 28. The velocity fluctuated gas flow interacts with the drops in the deflection zone 28 causing the drop trajectories to fluctuate to produce the observed periodic light and dark bands in the image on the receiving media.

The amount of gas flow velocity fluctuation amplification is a function of (i) velocity difference between the fast gas flow in the gas duct and the slow gas flow in the offset region 401, (ii) the width of the offset region 401, (iii) the distance the oscillated gas flow travels, and (iv) the velocity fluctuation amplitude from the gas flow coming from the gas flow source etc. In general, the bigger the velocity difference, the wider the gap, and the longer the travel distance, the larger the oscillation amplitudes.

Referring back to FIG. 3, one example embodiment that reduces or even eliminates instability is shown. The inner surface of the upper wall 76 is aligned with the beveled surface 15 of the drop generator 10, that is, the inner surface of the upper wall 76 is parallel and co-planer with the beveled face 15 of the drop generator 10.

Figure 4B:
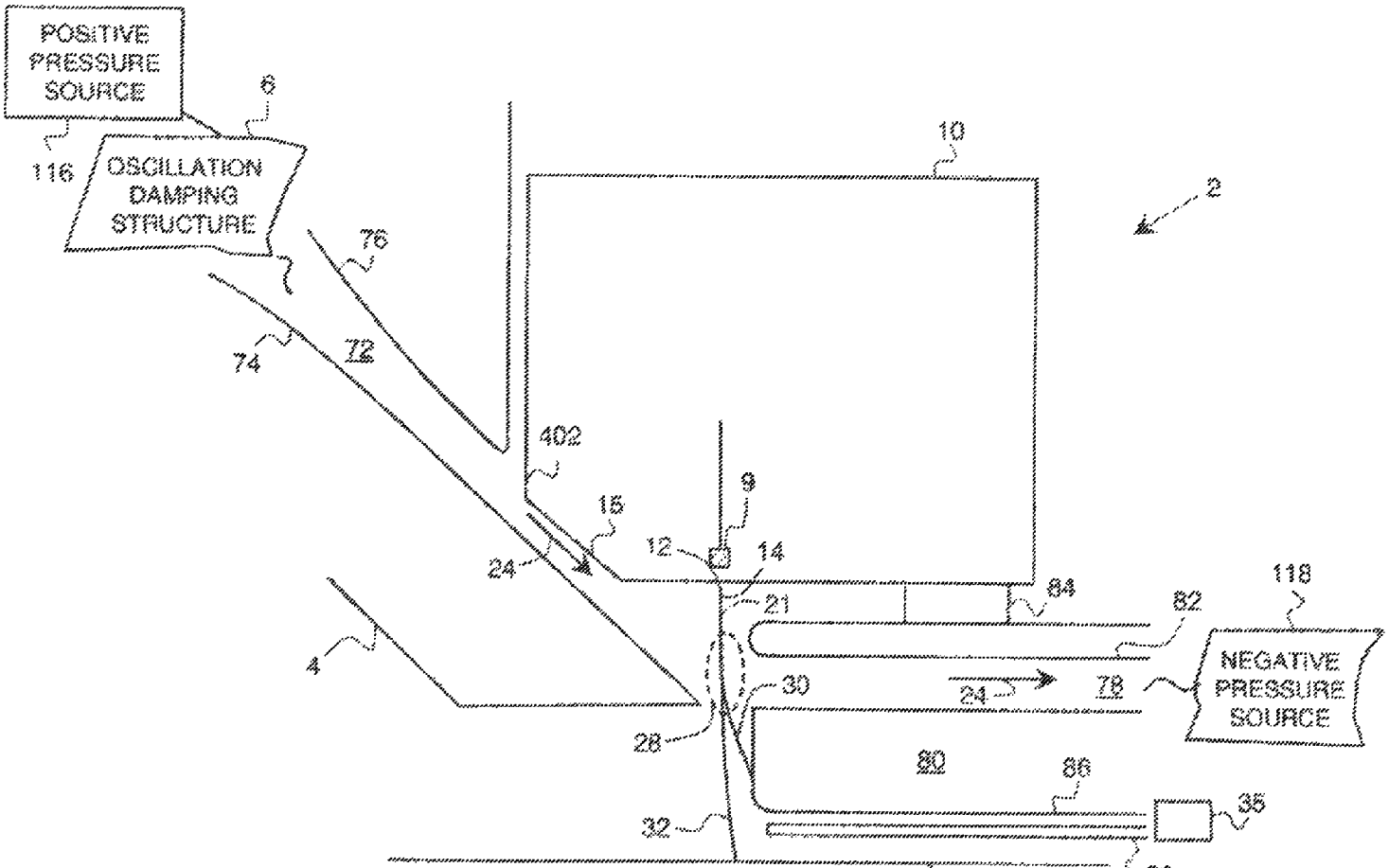

To understand the importance of alignment between the inner surface of the upper wall 76 and the beveled surface 15 of the drop generator 10, as another case scenario, FIG. 4(B) schematically shows the drop generator 10 is extruded such that the beveled surface 15 is below the plane of the inner surface of the upper wall 76. In this case, the instability isn't produced but rather the gas flow in the gas duct 72 directly interacts with the surface 402 of the drop generator 10, causes unstable gas flow.

The term "alignment" means the proper positioning the parts in relation to each other. As one specific example of alignment in FIG. 1 and FIG. 3, the inner surface of the upper wall 76 is parallel and co-planer with the beveled face 15 of the drop generator 10. However, due to various designs of the drop generator and the gas ducts, "alignment" in this context should be understood as smooth transient of gas flow from the gas duct 72 to the drop deflection zone 28.

Figure 5:
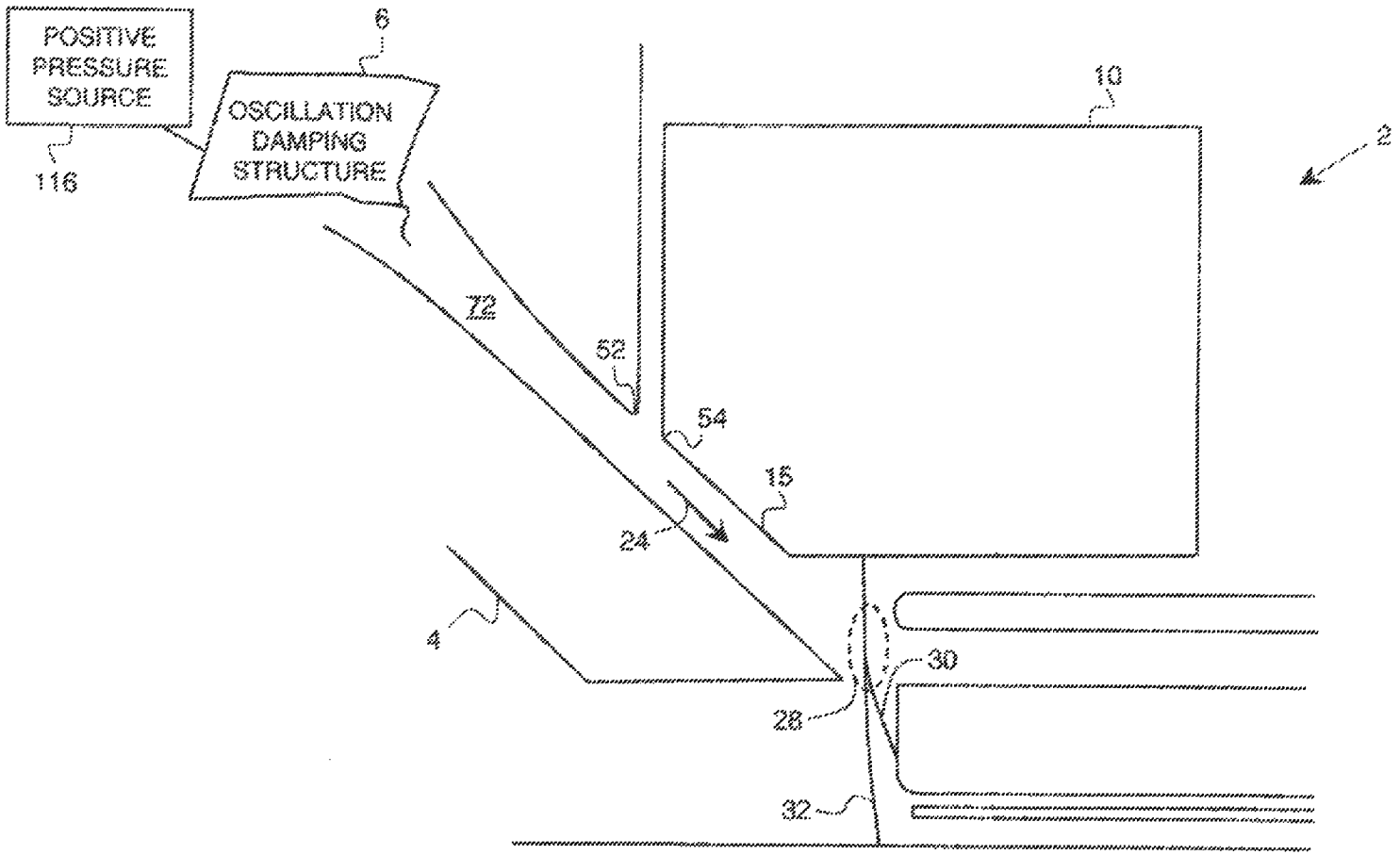
FIG. 5 is a schematic side view of a printing system including another embodiment of the present invention.

Referring to FIG. 5, mathematically, "alignment" in this context means:

(1) $v_{52}=v_{54}$, The gas flow velocity $v_{52}$ near the tip 52 of the gas duct is substantially equivalent to the gas flow velocity $v_{54}$ near the tip 54 of the drop generator 10; and $$\frac{dv_{52}}{dx_i} = \frac{dv_{54}}{dx_i}, \tag{2}$$

The first derivative of the gas flow velocity near the tip 52

$$\frac{dv_{52}}{dx_i}$$

of the gas duct is substantially equivalent to the first derivative of the gas flow velocity near the tip 54

$$\frac{dv_{54}}{dx_i}$$

of the drop generator 10. Where $x_i$ (i=1, 2 and 3) are three orientations of a Cartesian coordinate system.

In such a context, it is not necessarily for the beveled face 15 of the drop generator 10 to be a plane surface, though a plane surface is preferred for manufacturing considerations.

Figure 6:
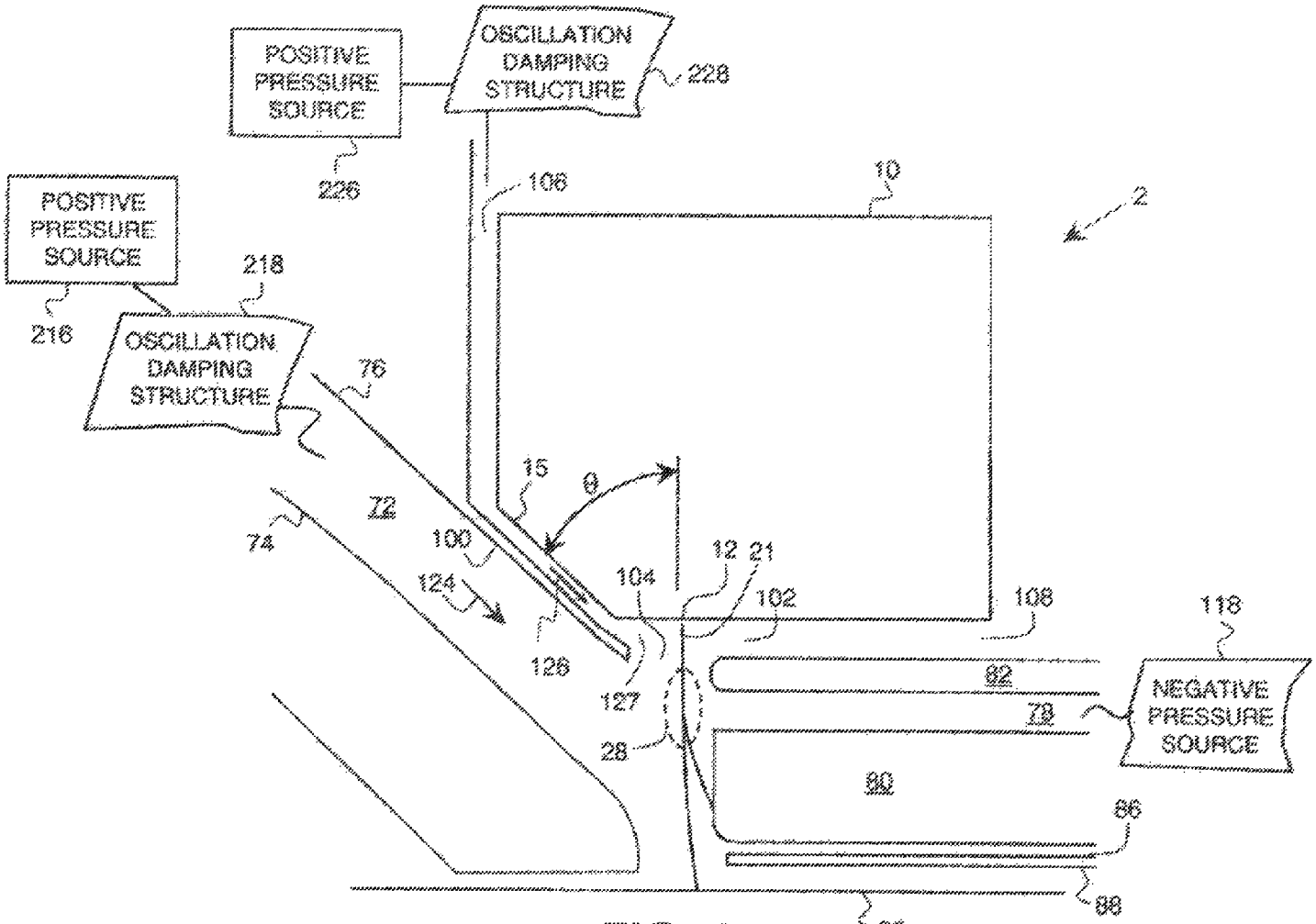
FIG. 6 is a schematic side view of a printing system including another embodiment of the present invention.

FIG. 6 schematically shows a side-view of a print apparatus including another example embodiment of the present invention. As shown in FIG. 3, a drop generator 10 is configured to selectively form large volume drops and small volume drop from liquid emitted through nozzles 12 associated with the drop generator. The large volume drops and the small volume drops travel along an initial trajectory of drop stream 21. A first gas flow 124 having a first speed flowing along the gas duct 72 directs toward the trajectory of the drop stream 21. A portion of this gas flow passes through the drop deflection zone 28 and exits through the gas flow duct 78.

A plenum structure 100 including an outlet located between the drop generator 10 and the gas flow duct that directs a second gas flow 126 towards the initial trajectory of drop stream 21. The second gas flow has a second speed. The first speed of the first gas flow 124 adjacent to the outlet 127 of the plenum structure 100 is substantially equivalent to the second speed of the second gas flow 126 at the outlet 127 of the plenum structure 100. The second gas flow 126 is substantially parallel to the first gas flow 124 in the drop deflection zone 28. With the first speed of the first gas flow 124 substantially equivalent to the second speed of the second gas flow 126, and the first gas flow 124 substantially parallel to the second gas flow 126, there would be minimum velocity shear present within the gas flow close to the outlet 127 of the plenum structure 100 because there is no significant velocity difference across the interface between two fluids. As both the first gas flow 124 and the second gas flow 126 are parallel, and there is minimum velocity difference between the two gas flow near the outlet 127 of the plenum structure 100, instability is suppressed.

The first gas flow 124 is provided by a first positive pressure source 216 connected in fluid communication to the gas flow duct 72. Typically, the first positive pressure source 216 is a gas fan, a gas blower or a gas pump etc. The gas flow deflection system includes a gas flow pressure oscillation damping structure 218, such as the one described above located between the first gas flow source 216 and the drop deflection zone 28. The gas flow pressure oscillation damping structure 218 comprises a porous media positioned in the gas flow duct 72 such that at least a portion of the gas flows through the porous media.

The second gas flow 126 is provided by a second positive pressure source 226 connected in communication with the plenum structure 100. Typically, the second positive pressure source 216 is a gas fan, a gas blower or a gas pump etc. A gas flow pressure oscillation dampening structure 228, such as the one described above is located between the gas flow source and the outlet 127 of the plenum structure 100. The gas flow pressure oscillation damping structure 218 comprises a porous media positioned in the gas flow duct 106 such that at least a portion of the gas flows through the porous media.

As stated above, the instability can be suppressed when the first speed of the first air flow 124 is substantially the same as the second speed of the second air flow at the outlet 127 of the plenum structure. In terms of suppressing the instability, the first and second gas flow speeds are substantially the same if the second speed differs from the first speed by less than 40% of the first speed.

Figure 7:
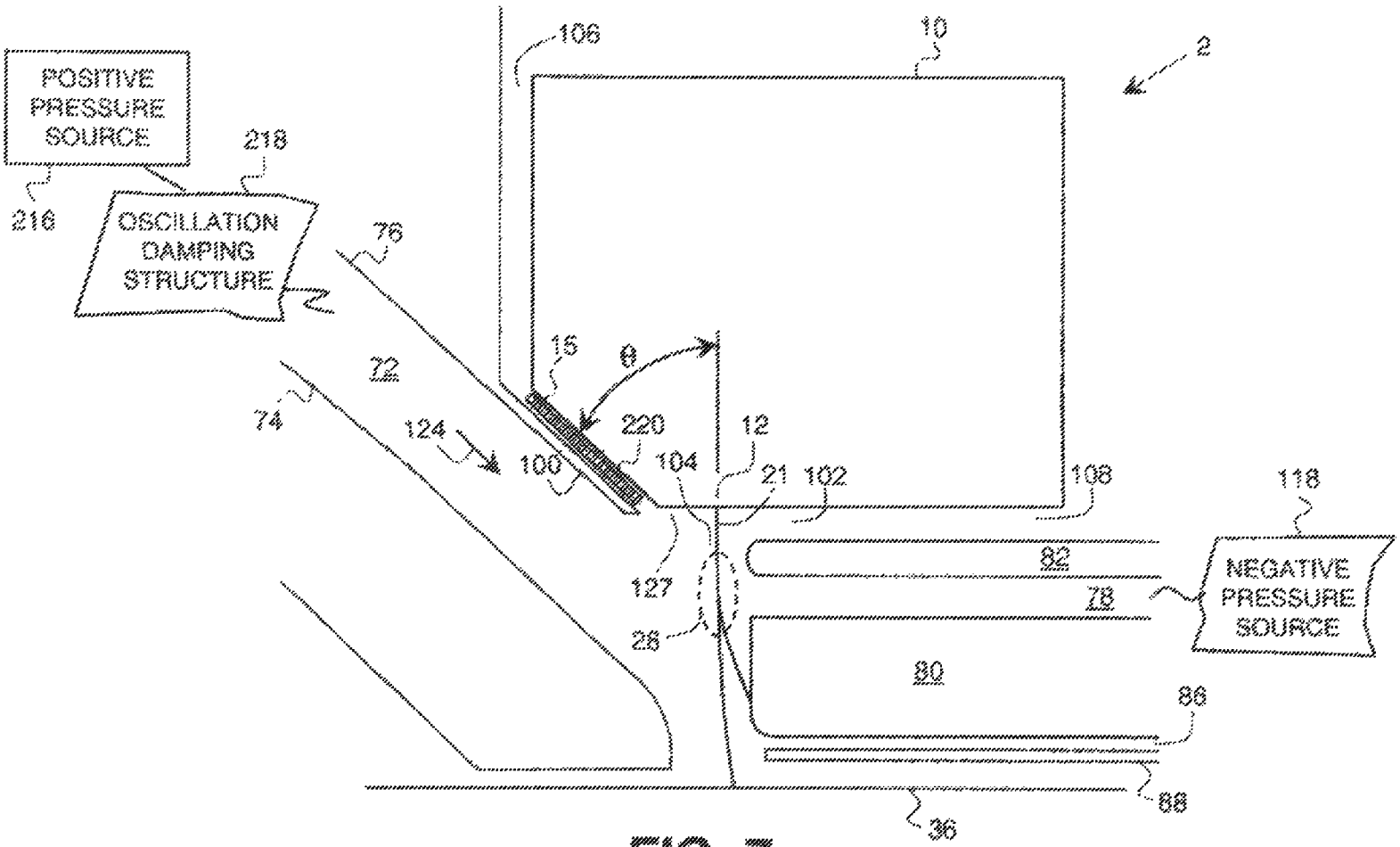
FIG. 7 is a schematic side view of a printing system including another embodiment of the present invention.

Referring to FIG. 6, usually the plenum structure 100 has to be very thin so that the plenum structure 100 can be accommodated between the drop generator 10 and the gas duct 72. The plenum structure 100 needs to be rigid to minimize vibrations that can be caused by the gas flow 124 and gas flow 126. It is preferred that the surfaces of the plenum structure 100 are polished. An air plenum 102 is formed between the drop generator 10 and the plenum structure 100 and upper wall 82. The air plenum 102 can be open as it is shown, or be sealed with a seal, for example, seal 84 shown in FIG. 1. FIG. 7 schematically shows a side-view of another example embodiment of the present invention. In this embodiment, the gas flow duct 106 is sealed with a seal 220.

Also in the description above, the term "gas" is intended to include gases such as air, vapor, carbon dioxide, and any suitable gaseous fluid. Additionally, the gases that are provided to the deflection zone can be filtered or cleaned prior to delivery to the deflection zone to help maintain a clean printhead environment. The drops are typically drops of liquid inks, but can include other liquid mixtures desirable for selective application to a receiver. Typically, receivers include a print media when the drops are ink. However, when the drops are other types of liquid, the receiver can be other structures, for example, circuit board material, stereo-lithographic substrates, medical delivery devices, etc.

The invention has been described in detail with particular reference to certain example embodiments thereof, but it will be understood that variations and modifications can be effected within the scope of the invention.

PARTS LIST

2 printhead
4 gas flow deflection system
6 gas flow pressure oscillation damping structure
9 stimulation device
10 drop generator
12 at least one nozzle
14 liquid
15 beveled surface
21 drops stream
24 gas flow
28 drop deflection zone
30 small drop trajectory
32 large drop trajectory
35 fluid system
36 receiving media
52 tip
54 tip
72 gas flow duct
74 lower wall
76 upper wall
78 another air duct
80 catcher
82 upper wall
84 optional seals
86 ink return duct
88 plate
100 plenum structure
102 air plenum
106 gas flow duct
116 positive pressure source
118 negative pressure source
124 first gas flow
126 second gas flow
127 outlet
216 first positive pressure source
218 gas flow pressure oscillation damping structure
220 seal
226 second positive pressure source
228 gas flow pressure oscillation dampening structure
302 gas flow velocity profile

304 mean velocity
306 velocity fluctuation
401 offset
402 surface

The invention claimed is:

1. A printhead comprising:

a drop generator configured to selectively form a large volume drop and a small volume drop from liquid emitted through a nozzle associated with the drop generator, the large volume drop and the small volume drop traveling along an initial drop trajectory, the drop generator including a beveled face; and a gas flow deflection system including a gas flow that interacts with the large volume drop and the small volume drop in a drop deflection zone such that at least the small volume drop is deflected from the initial drop trajectory, the gas flow being provided by a gas flow source connected in fluid communication with a gas flow duct comprising an upper wall, the upper wall including an inner surface, the gas flow deflection system including a gas flow pressure oscillation dampening structure located between the gas flow source and the drop deflection zone, wherein the gas flow is directed at a non-perpendicular non-parallel angle relative to the initial drop trajectory, wherein the inner surface of the upper wall is aligned with the beveled face of the drop generator, and wherein the inner surface of the upper wall is parallel and co-planer with the beveled face of the drop generator.

2. The printhead of claim 1, wherein the gas flow source is a positive pressure source.

3. The printhead of claim 1, wherein the gas flow pressure oscillation dampening structure comprises a porous media positioned in the gas flow duct such that at least a portion of the gas flows through the porous media.

* * * * *